US005569874A

United States Patent [19]

Nelson

[11] Patent Number: 5,569,874

[45] Date of Patent: Oct. 29, 1996

[54] FORMED WIRE BULLET

[76] Inventor: Eric A. Nelson, 2104 14th St., Lewiston, Id. 83501

[21] Appl. No.: 395,492

[22] Filed: Feb. 27, 1995

[51] Int. Cl.[6] ..... F42B 12/34

[52] U.S. Cl. ..... 102/507; 102/516; 102/517

[58] Field of Search ..... 102/474, 501, 102/506–510, 514–518

[56] References Cited

U.S. PATENT DOCUMENTS

| | | | |
|---|---|---|---|
| 1,892,152 | 12/1932 | Jones | 102/516 |
| 2,168,381 | 8/1939 | Woodford . | |
| 3,142,256 | 7/1964 | Mack . | |
| 3,208,386 | 9/1965 | Schneider et al. | 102/506 |
| 3,570,406 | 3/1971 | Frey et al. . | |
| 4,387,492 | 6/1983 | Inman . | |
| 4,546,704 | 10/1985 | Ballreich et al. . | |
| 4,616,569 | 10/1986 | Montier et al. | 102/517 |
| 4,685,397 | 8/1987 | Schirneker . | |
| 4,819,563 | 4/1989 | Bodet | 102/501 |
| 4,836,110 | 6/1989 | Burczynski | 102/508 |
| 4,996,924 | 3/1991 | McClain . | |
| 5,164,538 | 11/1992 | McClain, III . | |
| 5,440,994 | 8/1995 | Alexander | 102/506 |

FOREIGN PATENT DOCUMENTS

| | | | |
|---|---|---|---|
| 4227068 | 2/1994 | Germany | 102/501 |
| WO92/08097 | 5/1992 | WIPO | 102/514 |

*Primary Examiner*—Harold J. Tudor

*Attorney, Agent, or Firm*—Klarquist Sparkman Campbell Leigh & Whinston, LLP

[57] ABSTRACT

A bullet is formed of a plurality of elongate malleable elements, such as copper wires, disposed in an entwined composite mass. Elongate elements extend in a helical pattern from the tail end toward the nose end of the mass and are compacted into a bullet-shaped configuration. The tail end of the elements may be encircled by a jacket which retains the elements against separation, while the nose end portions of the elements are capable of separation upon striking an object.

8 Claims, 1 Drawing Sheet

FORMED WIRE BULLET

BACKGROUND AND SUMMARY OF THE INVENTION

This invention relates to a bullet comprising a plurality of elongate malleable elements and a method for producing such a bullet.

In shooting on an indoor range, and in other uses of firearm ammunition it often is desirable that the bullet, or projectile, mushroom, or otherwise expansively deform, upon impact. Further, in the use of ammunition, and particularly in enclosed range situations, it is desirable to have ammunition which minimizes, or prevents ricochet and the release of airborne lead.

A primary object of the present invention is to provide a novel bullet which is so constructed that on impact elements forming the nose of the bullet separate easily to produce mushrooming.

Another object of the present invention is to provide such a novel bullet having a jacket surrounding the tail portion of the bullet, which resists separation of tail portions of the bullet.

A further object of the present invention is to provide a novel bullet which is made of malleable metal elements devoid of lead.

More specifically, an object of the present invention is to provide a novel bullet which is comprised of a plurality of elongate malleable elements disposed in an entwined composite mass.

A further object is to provide a novel bullet comprised of a plurality of elongate malleable elements which may extend in either a helical pattern or be wires which are interwoven in a braided or other entwined pattern.

A still further object of the present invention is to provide such a novel bullet wherein elongate malleable elements disposed in an entwined composite mass are compacted to provide a body in which the elements are formed into and will retain a bullet configuration without separation when fired from a firearm, but are capable of separation upon striking an object. Upon striking the object the elongate elements may separate into a tangled mass, in effect mushrooming. The use of such multiple strand elements allows separation-style deformation to minimize ricochet.

Another object of the present invention is to provide a novel method for producing a bullet in which a plurality of elongate discrete malleable elements are provided in an entwined mass having a cross-sectional size in the range of the desired diameter of the finished bullet and a length in the range of the desired length for the finished bullet, and compacting the mass to a desired bullet shape to provide a body in which the elements are formed into and will retain the bullet shape without separation when fired from a firearm, but are capable of separation upon striking an object.

Another object is to provide such a novel method in which the elongate elements are disposed in a helical pattern extending generally longitudinally of the body which fosters ease and efficiency in compaction into a bullet shape.

A still further object is to provide such a novel method for producing a bullet wherein, prior to compacting the mass, a tail end portion of the mass is inserted into a surrounding jacket, and upon compacting the mass is deformed to substantially fill the jacket and be frictionally held therein, with the nose portion of the mass extending outwardly from the jacket.

DRAWINGS

The manner in which the foregoing and other objects and advantages of the invention are accomplished will become more clearly apparent from the accompanying specifications and claims, considered with the drawings wherein:

DETAILED DESCRIPTION OF A PREFERRED EMBODIMENT

Figure 1:
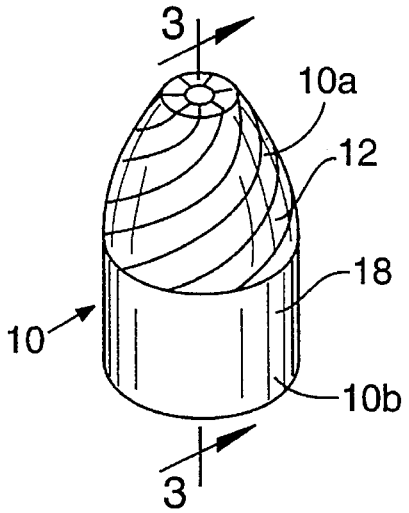
FIG. 1 is a perspective view of a bullet constructed according to the invention.
Figure 2:
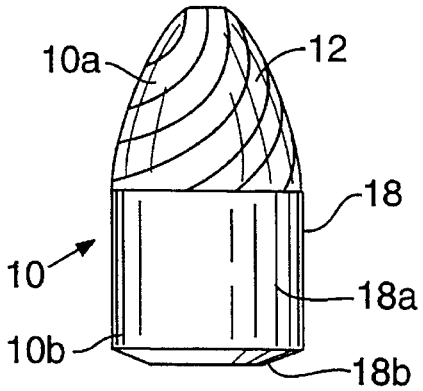
FIG. 2 is a side elevation view of the bullet of FIG. 1.

Referring to the drawings, and first more particularly to FIGS. 1 and 2, a bullet constructed according to an embodiment of the invention is indicated generally at 10. The bullet has a somewhat pointed nose portion 10*a* and a tail portion 10*b*. It should be recognized that other bullet configurations also may be formed according to the present invention.

Figure 4:
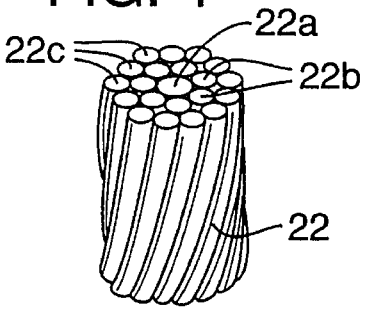
FIGS. 4, 5 and 6 are perspective views of materials used in formation of the body for the bullet.
Figure 5:
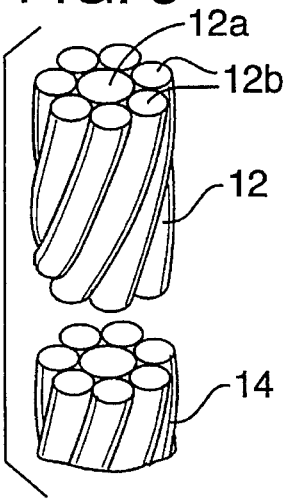
Figure 6:
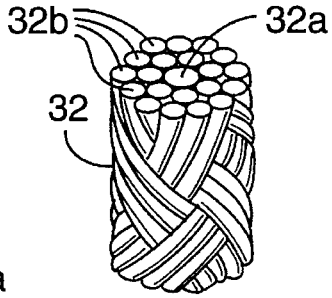

The main body portion 12 of the bullet comprises a plurality of elongate malleable elements disposed in an entwined composite mass as shown in the various materials illustrated in FIGS. 4, 5 and 6. In the illustrated embodiments, and in products manufactured in prototype and found to work well the material used for the body is solid copper wire (CDA-110).

Referring to FIG. 5 a mass used to form the main body portion of the bullet may be a length of material 12 severed from a longer piece of such material 14.

The material illustrated in FIG. 5 includes a plurality of elongate malleable elements, such as an inner element, or wire, 12*a* and a plurality of outer elements, or wires, 12*b*. In the illustrated embodiment, and for exemplary purposes, the inner wire 12*a* may have diameter of approximately 0.140 inch and the outer wires 12*b* a diameter of approximately 0.100 inch. The inner wire extends substantially longitudinally of the body from the tail end to the nose end thereof. The outer wires extend in a substantially helical pattern, about 12*a* as they extend from the tail end toward the nose end of the body.

The body 12 and the wires therein would be so formed that they would maintain their positions closely 10 adjacent each other after severing from material 14 and while continuing through the manufacturing process as will be discussed below.

The bullet also may include a cylindrical jacket 18. In the illustrated embodiment the jacket is a cup-shaped member having a cylindrical side wall 18*a* and a bottom wall 18*b*.

Figure 7:
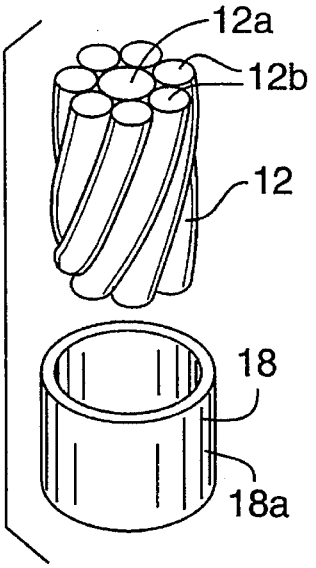
FIG. 7 illustrates a composite wire mass of selected length ready for insertion into a jacket forming a portion of a bullet constructed according to the invention.

In the manufacture of a bullet according to one embodiment of the present invention, and referring to FIGS. 1–3, 5 and 7, a length of body material 14 is initially provided of a length substantially greater than the length of a single bullet to be formed. Its diameter is in the range of, but slightly less than, the desired final diameter for the bullet. A section 12 is severed from length 14 and has a length in the range of, but slightly greater, than the desired bullet length. Body portion, or mass, 12 as illustrated in FIG. 7 is inserted into jacket 18 with its tail end portion encircled, or encased, by jacket 18 and its nose end portion projecting outwardly therefrom.

After the body portion has been inserted into the jacket swaging operations are performed on the nose portion of the body mass extending outwardly from the jacket to compact the malleable elements 12*a*, 12*b* into an appropriate bullet shape, or configuration, such that they will retain their bullet configuration without separation when fired from a firearm, but will be capable of separation upon striking an object.

Figure 3:
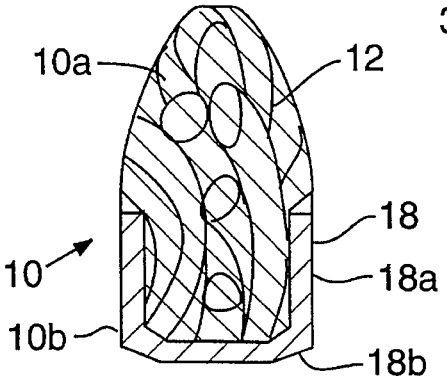
FIG. 3 is a cross-sectional view taken generally along the line 3—3 in FIG. 1.

The bullet thus formed is illustrated in FIGS. 1–3. As is seen in the figures the nose portions of the malleable elements 12*a*, 12*b* are compacted into a bullet-shaped configuration. As is best illustrated in FIG. 3, the tail end portion of mass 12, and the elements 12*a*, 12*b* therein during the compacting step are deformed to substantially fill the jacket and be frictionally held therein.

In the initial portions of the manufacturing process, the body 12 as shown in FIGS. 5 and 7 has a diameter which is in the range of the diameter of the bullet to be produced, but is somewhat smaller such that it will fit conveniently into jacket 18. The body 12 has a length which is in the range of the length of the bullet to be produced, but is somewhat longer than the desired final length of the bullet, to provide sufficient mass to be compacted into the bullet configuration and to be deformed to frictionally hold within jacket 18.

It has been found that the pre-compaction diameter of body 12 should preferably be in a range of 70–90% of the desired final maximum diameter of a finished bullet and its length should be in a range of 110–135% of the finished bullet length. This will be dependent upon the structure of material in body 12.

FIG. 4 illustrates another form of body material 22 having a central, inner element 22*a* which extends substantially longitudinally of the mass, and a plurality of intermediate elements 22*b* and outer elements 22*c*, ringing element 22*a* in helical, or spiral wound, orientation.

FIG. 6 illustrates yet another embodiment of an entwined composite mass of elongate malleable elements 32 to be used as a length of body material in the bullet of the present invention. In this embodiment the wires are interwoven in a braided pattern, with a central, or inner, wire 32*a* and spiral or helically, disposed outer wires 32*b* extending in braided fashion thereabout.

Each of the segments of body materials 22, 32 would be used in the manufacture of a bullet similar to that described above in regard to material 12.

In the embodiments disclosed the wire elements used are devoid of lead. As discussed above, a material which has been found to work well is solid copper (CDA-110).

It has been found that a bullet produced as described above produces desired results when none of the elongate malleable elements comprises more than a minor portion of the cross-sectional area of the body. Referring to FIG. 5 for example, it will be seen that there are a sufficient number of elements 12*a*, 12*b* and their sizes are such that no one element has a cross-sectional area which is a major portion of the total cross-sectional area of the body. This should remain true for any cross-sectional plane cut perpendicular to the longitudinal axis of the bullet formed as illustrated in FIG. 1.

It has been found that preferably the cross-sectional area of no element should be greater than 25% of the cross-sectional area of the body, and more preferably each element should be within a range of 3 to 15% of the cross-sectional area of the body.

Figure 8:
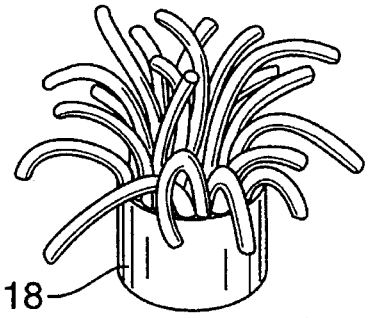
FIG. 8 illustrates the bullet after firing and impacting an object.

The bullet thus formed has been found to retain its bullet shaped configuration without separation when fired from a firearm, but the nose elements are capable of separation for expansive deformation upon striking an object. FIG. 8 illustrates what such a bullet might look like after impact against an object wherein the bullet has been produced using a body element with a number of wires as illustrated in FIGS. 4 or 6. It will be seen that the tail end portions of the wire elements are retained against separation within jacket 18, whereas the nose portions of the elements which project forwardly therefrom in the compacted bullet nose shape separate into a rather tangled mass upon impact.

In one example of the manufacture of a bullet according to the invention, a nine millimeter Luger bullet was produced that weighed approximately 115 grs. In this bullet a body element as illustrated in FIG. 5 was used having a central wire, or strand, 12*a* and seven outer wires, or strands 12*b* thereabout, each composed of solid copper (CDA 110) and devoid of lead. The central strand had a diameter of approximately 0.140 inch, while the outer strands had a diameter of approximately 0.100 inch. The cup used was a cartridge brass cup 0.340 inch tall and 0.360 inch outside diameter.

Although preferred embodiments of the invention have been described herein, it is recognized that variations and modifications are possible without departing from the spirit of the invention.

What is claimed is:

1. A bullet having a body portion with a nose end and an opposed tail end comprising a plurality of elongate malleable elements disposed in an entwined composite mass wherein said elements include an inner element which extends substantially longitudinally and centrally of the body from the tail toward the nose end thereof, and a plurality of outer elements encircling said inner element which extend from the tail end toward the nose end and are disposed in a helical pattern about said inner element, and a cup-shaped jacket encircling the tail end of said body, the nose end portions of said element being exposed and compacted to provide a body in which the elements are formed into and will retain a bullet configuration without separation when fired from a firearm and during flight, and the tail end portions of said elements are bound together in said jacket to resist separation of said tail end portions, with nose end portions thereof remaining capable of separation into a tangled mass upon striking an object.

2. The bullet of claim 1, wherein said elements comprise interwoven wires.

3. The bullet of claim 2, wherein said wires are interwoven in a braided pattern.

4. The bullet of claim 1, wherein said elements are composed of a metal devoid of lead.

5. The bullet of claim 1, wherein said elements extend substantially longitudinally of the body from the tail end toward the nose end thereof.

6. The bullet of claim 1, wherein each element has a cross-sectional area which is a minor portion of the cross-sectional area of said body.

7. The bullet of claim 6, wherein each element has a cross-sectional area which is less than 25% of the cross-sectional area of the body.

8. The bullet of claim 6, wherein an element has a cross-sectional area which is in a range of from 3–15% of the cross-sectional area of the body.

* * * * *

UNITED STATES PATENT AND TRADEMARK OFFICE

CERTIFICATE OF CORRECTION

PATENT NO. : 5,569,874
DATED : October 29, 1996
INVENTOR(S) : Eric A. Nelson

It is certified that error appears in the above-indentified patent and that said Letters Patent is hereby corrected as shown below:

Column 2, line 46, "closely 10 adjacent" should read--closely adjacent--.
Column 4, line 35, claim 1, "element" should read--elements--.

Signed and Sealed this

Eighth Day of April, 1997

*Attest:*

*Attesting Officer*

BRUCE LEHMAN

*Commissioner of Patents and Trademarks*